US011320772B2

(12) United States Patent
Kaneko et al.

(10) Patent No.: US 11,320,772 B2
(45) Date of Patent: May 3, 2022

(54) IMAGE FORMING APPARATUS THAT ESTIMATES TONER DETERIORATION STATUS, FROM TONER USE AMOUNT AND DEVELOPING CURRENT

(71) Applicant: KYOCERA Document Solutions Inc., Osaka (JP)

(72) Inventors: Shiro Kaneko, Osaka (JP); Hiroka Itani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/470,804

(22) Filed: Sep. 9, 2021

(65) Prior Publication Data

US 2022/0075304 A1 Mar. 10, 2022

(30) Foreign Application Priority Data

Sep. 10, 2020 (JP) ..... JP2020-152059

(51) Int. Cl.
*G03G 15/00* (2006.01)
*G03G 15/08* (2006.01)

(52) U.S. Cl.
CPC ..... *G03G 15/5037* (2013.01); *G03G 15/0848* (2013.01); *G03G 15/5029* (2013.01)

(58) Field of Classification Search
CPC ..... G03G 15/5037; G03G 15/0848; G03G 15/5029
See application file for complete search history.

(56) References Cited

U.S. PATENT DOCUMENTS

2016/0202657 A1* 7/2016 Koseki ..... G03G 21/10 399/35
2020/0026219 A1* 1/2020 Nakachi ..... G03G 15/0851

FOREIGN PATENT DOCUMENTS

JP H08-179602 A 7/1996

* cited by examiner

*Primary Examiner* — Susan S Lee
(74) *Attorney, Agent, or Firm* — IP Business Solutions, LLC

(57) ABSTRACT

An image forming apparatus includes an image carrier, a developing device, a voltage applier, a current detector, a weight detector, and a control device. The control device acts as a first measurer, a second measurer, and an estimator. The first measurer acquires a toner use amount indicating weight per unit area, of the toner that has migrated from the developing agent carrier to the image carrier, according to a detection result provided by the weight detector. The second measurer acquires the developing current from the current detector. The estimator calculates a value of decision coefficient, obtained by dividing variance of an estimated value in a regression model between the toner use amount and the developing current, by variance of a sample value, and estimates deterioration status of the toner, according to the value of the decision coefficient.

7 Claims, 8 Drawing Sheets

IMAGE FORMING APPARATUS THAT ESTIMATES TONER DETERIORATION STATUS, FROM TONER USE AMOUNT AND DEVELOPING CURRENT

INCORPORATION BY REFERENCE

This application claims priority to Japanese Patent Application No. 2020-152059 filed on Sep. 10, 2020, the entire contents of which are incorporated by reference herein.

BACKGROUND

The present disclosure relates to an image forming apparatus.

In general, existing image forming apparatuses include a photoconductor drum, a developing roller, a supply roller, and a control device. The developing roller supplies toner to the photoconductor drum. The supply roller supplies the toner to the developing roller. The control device maintains a difference in charge density, between the current flowing between the supply roller and the developing roller, and the current flowing between the developing roller and the photoconductor drum, at a level equal to or smaller than a predetermined value, thereby preventing occurrence of fogging of the image.

SUMMARY

The disclosure proposes further improvement of the foregoing techniques.

In an aspect, the disclosure provides an image forming apparatus including an image carrier, a developing device, a voltage applier, a current detector, a weight detector, and a control device. The image carrier carries an electrostatic latent image. The developing device includes a developing agent carrier that carries a developing agent at least containing toner. The voltage applier applies a bias voltage to the developing agent carrier, to cause the toner to migrate from the developing agent carrier to the image carrier. The current detector measures developing current flowing between the developing agent carrier and the image carrier. The weight detector measures weight of the toner stuck to the image carrier. The control device includes a processor, and acts as a first measurer, a second measurer, and an estimator, when the processor executes a control program. The first measurer acquires a toner use amount indicating weight per unit area of the toner that has migrated from the developing agent carrier to the image carrier, according to a detection result provided by the weight detector. The second measurer acquires the developing current from the current detector. The estimator calculates a value of decision coefficient, obtained by dividing variance of an estimated value in a regression model between the toner use amount and the developing current, by variance of a sample value, and estimates deterioration status of the toner, according to the value of the decision coefficient.

DETAILED DESCRIPTION

Figure 1:
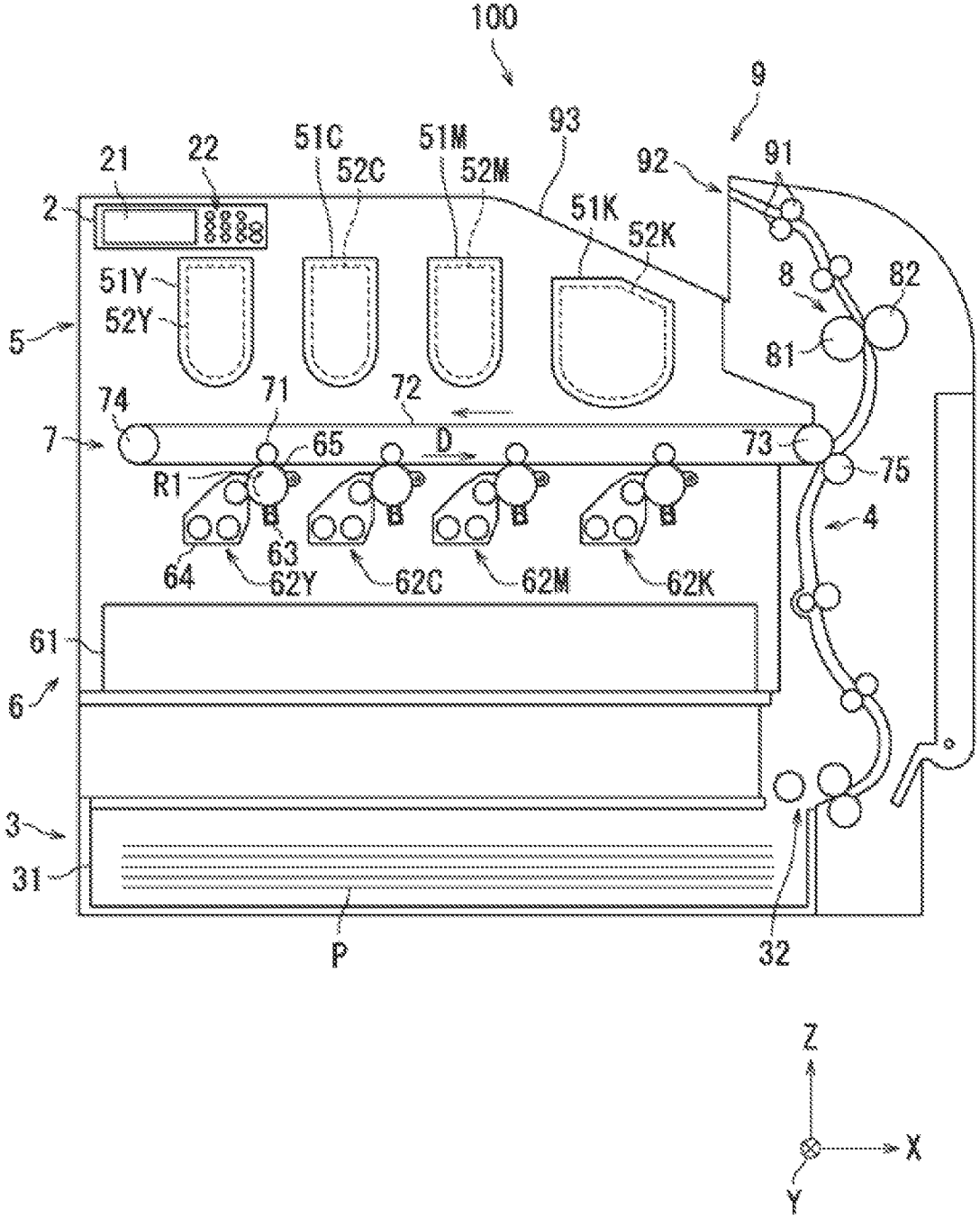
FIG. 1 is a schematic cross-sectional view showing an example of an image forming apparatus.

Hereafter, an embodiment of the disclosure will be described, with reference to the drawings. In the drawings, the same or corresponding elements are given the same numeral, and the description of such elements will not be repeated.

Referring to FIG. 1, an image forming apparatus 100 according to the embodiment of the disclosure will be described. FIG. 1 is a schematic cross-sectional view showing an example of the image forming apparatus. The image forming apparatus 100 is, for example, a color printer. For the sake of convenience in description, a left-right direction in FIG. 1 will be defined as X-direction, a depth direction will be defined as Y-direction, and an up-down direction will be defined as Z-direction.

As shown in FIG. 1, the image forming apparatus 100 includes an operation device 2, a paper feeding device 3, a transport device 4, a toner supply device 5, an image forming device 6, a transfer device 7, a fixing device 8, and a delivery area 9.

The operation device 2 receives instructions from a user. The operation device 2 includes an LCD 21 and a plurality of operation keys 22. The LCD 21 displays, for example, various processing results. The operation keys 22 include a tenkey, a start key, and so forth.

The paper feeding device 3 includes a paper cassette 31, and a feed roller group 32. The paper cassette 31 can accommodate therein a plurality of sheets P. The feed roller group 32 delivers the sheets P one by one from the paper cassette 31, to the transport device 4.

The transport device 4 includes rollers and guide members. The transport device 4 extends from the paper feeding device 3 to the delivery area 9. The transport device 4 transports the sheet P from the paper feeding device 3 to the delivery area 9, by way of the image forming device 6 and the fixing device 8.

The toner supply device 5 supplies the toner to the image forming device 6. The toner supply device 5 includes a first mounting base 51Y, a second mounting base 51C, a third mounting base 51M, and a fourth mounting base 51K.

On the first mounting base 51Y, a first toner container 52Y is mounted. Likewise, a second toner container 52C is mounted on the second mounting base 51C, a third toner container 52M is mounted on the third mounting base 51M, and a fourth toner container 52K is mounted on the fourth mounting base 51K. The first mounting base 51Y to the fourth mounting base 51K have the same configuration, except that different toner containers are mounted thereon.

The first toner container 52Y, the second toner container 52C, the third toner container 52M, and the fourth toner container 52K are each configured to accommodate the toner therein. In this embodiment, the first toner container 52Y accommodates yellow toner. The second toner container 52C accommodates cyan toner. The third toner container 52M accommodates magenta toner. The fourth toner container 52K accommodates black toner.

The image forming device 6 includes an exposure device 61, a first image forming unit 62Y, a second image forming unit 62C, a third image forming unit 62M, and a fourth image forming unit 62K.

The first image forming unit 62Y to the fourth image forming unit 62K each include a charging device 63, a developing device 64, and a photoconductor drum 65. The photoconductor drum 65 exemplifies the "image carrier" in the disclosure.

The charging device 63 and the developing device 64 are located along the circumferential surface of the photoconductor drum 65. In this embodiment, the photoconductor drum 65 rotates in the direction indicated by an arrow R1 in FIG. 1 (clockwise).

The charging device 63 uniformly charges, by electric discharge, the photoconductor drum 65 to a predetermined polarity. In this embodiment, the charging device 63 charges the photoconductor drum 65 to the positive polarity. The exposure device 61 emits a laser beam to the photoconductor drum 65 charged as above. As result, an electrostatic latent image is formed on the surface of the photoconductor drum 65.

The developing device 64 develops the electrostatic latent image formed on the surface of the photoconductor drum 65, thereby forming a toner image. The toner is supplied from the toner supply device 5, to the developing device 64. The developing device 64 applies the toner supplied from the toner supply device 5, to the surface of the photoconductor drum 65. As result, the toner image is formed on the surface of the photoconductor drum 65.

In this embodiment, the developing device 64 in the first image forming unit 62Y is connected to the first mounting base 51Y. Accordingly, the yellow toner is supplied to the developing device 64 in the first image forming unit 62Y. On the surface of the photoconductor drum 65 of the first image forming unit 62Y, a yellow toner image is formed.

The developing device 64 in the second image forming unit 62C is connected to the second mounting base 51C. Accordingly, the cyan toner is supplied to the developing device 64 in the second image forming unit 62C. On the surface of the photoconductor drum 65 of the second image forming unit 62C, a cyan toner image is formed.

The developing device 64 in the third image forming unit 62M is connected to the third mounting base 51M. Accordingly, the magenta toner is supplied to the developing device 64 in the third image forming unit 62M. On the surface of the photoconductor drum 65 of the third image forming unit 62M, a magenta toner image is formed.

The developing device 64 in the fourth image forming unit 62K is connected to the fourth mounting base 51K. Accordingly, the black toner is supplied to the developing device 64 in the fourth image forming unit 62K. On the surface of the photoconductor drum 65 of the fourth image forming unit 62K, a black toner image is formed.

The transfer device 7 superposes the respective toner images formed on the surface of the photoconductor drum 65 of the first image forming unit 62Y to the fourth image forming unit 62K, and transfers the superposed the toner images to the sheet P In this embodiment, the transfer device 7 transfers the superposed toner images to the sheet P, through a secondary transfer process. To be more detailed, the transfer device 7 includes four primary transfer rollers 71, an intermediate transfer belt 72, a drive roller 73, a follower roller 74, and a secondary transfer roller 75.

The intermediate transfer belt 72 is an endless belt stretched around the four primary transfer rollers 71, the drive roller 73, and the follower roller 74. The intermediate transfer belt 72 is driven by the rotation of the drive roller 73. In FIG. 1, the intermediate transfer belt 72 rotates counterclockwise. The follower roller 74 is made to rotate by the movement of the intermediate transfer belt 72.

The first image forming unit 62Y to the fourth image forming unit 62K are opposed to the lower surface of the intermediate transfer belt 72, and aligned along the moving direction D thereof. In this embodiment, the first image forming unit 62Y to the fourth image forming unit 62K are aligned in this order, from the upstream side toward the downstream side in the moving direction D of the lower surface of the intermediate transfer belt 72.

The primary transfer rollers 71 are each opposed to the photoconductor drum 65 via the intermediate transfer belt 72, and pressed against the photoconductor drum 65. Therefore, the toner image formed on the surface of each of the photoconductor drums 65 is sequentially transferred to the intermediate transfer belt 72. In this embodiment, the yellow toner image, the cyan toner image, the magenta toner image, and the black toner image are superposed and transferred in this order, onto the intermediate transfer belt 72.

The secondary transfer roller 75 is opposed to the drive roller 73, via the intermediate transfer belt 72. The secondary transfer roller 75 is pressed against the drive roller 73. Accordingly, a transfer nip is defined between the secondary transfer roller 75 and the drive roller 73. When the sheet P passes the transfer nip, the toner images superposed on the intermediate transfer belt 72 are transferred to the sheet P The sheet P having the toner images transferred thereto is transported by the transport device 4, toward the fixing device 8.

The fixing device 8 includes a heating member 81 and a pressing member 82. The heating member 81 and the pressing member 82 are opposed to each other, so as to define a fixing nip. The sheet P transported from the image forming device 6 is heated at a predetermined fixing temperature under a pressure, while passing the fixing nip. As result, the toner image is fixed to the sheet P The sheet P is transported by the transport device 4, from the fixing device 8 to the delivery area 9.

The delivery area 9 includes a delivery roller pair 91 and an output tray 93. The delivery roller pair 91 delivers the sheet P to the output tray 93, through a delivery port 92. The delivery port 92 is located on the upper side of the image forming apparatus 100.

Figure 2:
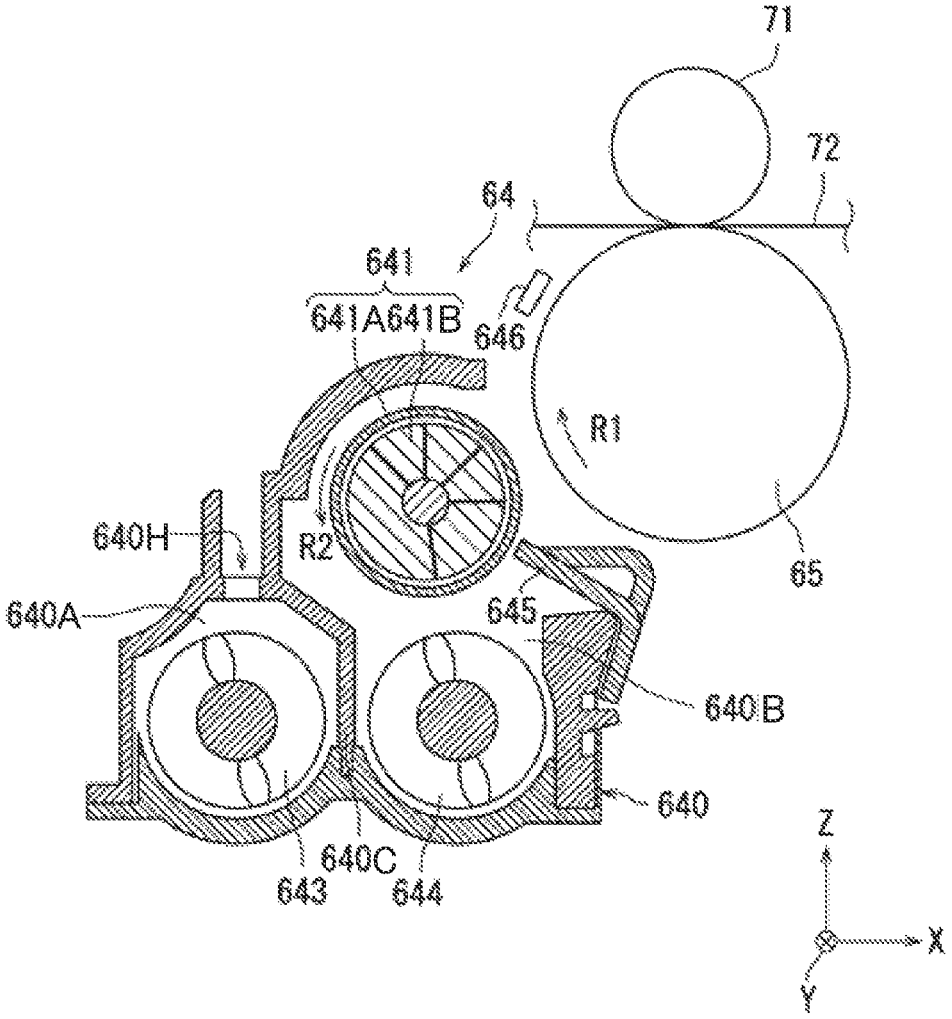
FIG. 2 is an enlarged cross-sectional view showing a detailed configuration of a developing device.

Referring to FIG. 1 and FIG. 2, the configuration of the developing device 64 will be described, in further detail. FIG. 2 is an enlarged cross-sectional view showing the detailed configuration of the developing device 64. In FIG. 2, the charging device 63 is not shown.

In this embodiment, as shown in FIG. 2, the developing device 64 includes a developing container 640 in which a two-component developing agent is stored. The developing device 64 includes, inside the developing container 640, a developing roller 641, a first mixing screw 643, a second mixing screw 644, and a blade 645. To be more detailed, the developing roller 641 is opposed to the second mixing screw 644. The blade 645 is opposed to the developing roller 641. The developing roller 641 exemplifies the "developing agent carrier" in the disclosure.

The developing container 640 is divided into a first mixing chamber 640A and a second mixing chamber 640B, by a partition wall 640C. The partition wall 640C extends in the axial direction of the developing roller 641 (Y-direction in FIG. 2). The first mixing chamber 640A and the second mixing chamber 640B communicate with each other, through an outer region of the end portions of the partition wall 640C in the longitudinal direction.

In the first mixing chamber 640A, the first mixing screw 643 is provided. In the first mixing chamber 640A, a magnetic carrier is stored. To the first mixing chamber 640A, a non-magnetic toner is supplied through a toner inlet 640H.

In the second mixing chamber 640B, the second mixing screw 644 is provided. In the second mixing chamber 640B, the magnetic carrier is stored.

The toner is stirred by the first mixing screw 643 and the second mixing screw 644, thus to be mixed with the carrier. As result, the two-component developing agent composed of the carrier and the toner is formed. The two-component developing agent exemplifies the "developing agent" in the disclosure.

The first mixing screw 643 and the second mixing screw 644 circulate and stir the developing agent, between the first mixing chamber 640A and the second mixing chamber 640B. As result, the toner is charged to a predetermined polarity. In this embodiment, the toner is positively charged.

The developing roller 641 includes a non-magnetic rotary sleeve 641A and a magnetic body 641B. The magnetic body 641B is fixed inside the rotary sleeve 641A. The magnetic body 641B includes a plurality of magnetic poles. The developing agent is adsorbed to the developing roller 641, by the magnetic force of the magnetic body 641B. As result, a magnetic brush is formed on the surface of the developing roller 641.

In this embodiment, the developing roller 641 rotates in the direction indicated by an arrow R2 in FIG. 2 (counter-clockwise). The developing roller 641 transports, by rotating, the magnetic brush to the position opposite the blade 645. The blade 645 is located so as to define a gap between the blade 645 and the developing roller 641. Accordingly, the thickness of the magnetic brush is defined by the b blade 645. The blade 645 is located on the upstream side in the rotating direction of the developing roller 641, with respect to the position where the developing roller 641 and the photoconductor drum 65 are opposed to each other.

A predetermined voltage is applied to the developing roller 641. Accordingly, the developing agent layer formed on the surface of the developing roller 641 is transported to the position opposite the photoconductor drum 65, and the toner in the developing agent adheres to the photoconductor drum 65.

To measure the weight of the toner stuck to the photoconductor drum 65, an optical sensor 646 is provided. The optical sensor 646 is located on the downstream side in the rotating direction of the photoconductor drum 65, with respect to the position where the developing roller 641 and the photoconductor drum 65 are opposed to each other. The optical sensor 646 is located on the upstream side in the rotating direction of the photoconductor drum 65, with respect to the position where the primary transfer roller 71 and the photoconductor drum 65 are opposed to each other. The optical sensor 646 exemplifies the "weight detector" in the disclosure.

The optical sensor 646 includes a light emitting element and a photodetector. The light emitting element emits light to the surface of the photoconductor drum 65. The photodetector detects reflected light from the surface of the photoconductor drum 65. The volume of the reflected light received by the photodetector varies depending on the weight of the toner present on the surface of the photoconductor drum 65. Therefore, the toner weight can be obtained, on the basis of the reflected light volume.

Figure 3:
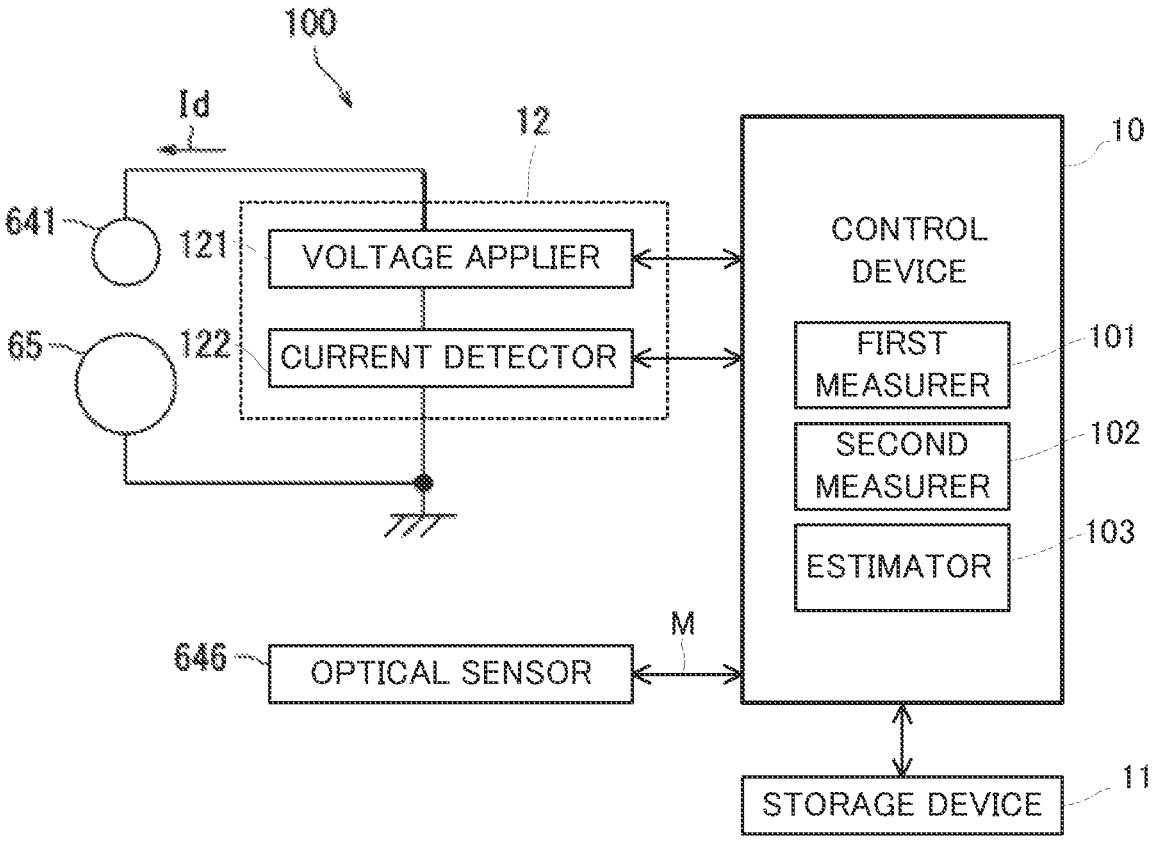
FIG. 3 is a block diagram showing an example of a circuit configuration of the image forming apparatus.

Referring now to FIG. 2 and FIG. 3, a circuit configuration of the image forming apparatus 100 will be described hereunder. FIG. 3 is a block diagram showing an example of the circuit configuration of the image forming apparatus 100.

As shown in FIG. 3, the image forming apparatus 100 includes a control device 10, a storage device 11, and a high-voltage applying substrate 12, in addition to the photoconductor drum 65, the developing roller 641, and the optical sensor 646.

The storage device 11 includes memory units. In the storage device 11, various types of data and computer programs are stored. The storage device 11 includes a main memory unit such as a semiconductor memory, and an auxiliary memory unit such as a hard disk drive.

The control device 10 includes a processor, for example a central processing unit (CPU). The control device 10 controls the components of the image forming apparatus 100, by executing the computer program stored in the storage device 11. More specifically, the control device 10 acts as a first measurer 101, a second measurer 102, and an estimator 103, by executing the computer program stored in the storage device 11.

The high-voltage applying substrate 12 includes a voltage applier 121 and a current detector 122. The voltage applier 121 applies a bias voltage to the developing roller 641, to cause the toner to migrate from the developing roller 641 to the photoconductor drum 65. The bias voltage refers to a voltage in which an AC bias is superposed on a DC bias. The current detector 122 is an ammeter for measuring a developing current Id, flowing between the developing roller 641 and the photoconductor drum 65.

The first measurer 101 controls the operation of the light emitting element and the photodetector of the optical sensor 646, to measure a toner use amount M indicating the weight per unit area of the toner that has migrated from the developing roller 641 to the photoconductor drum 65.

The second measurer 102 controls the operation of the voltage applier 121 and the current detector 122, to measure the developing current Id. The control device 10 controls the exposure device 61, in the measurement mode of the toner use amount M and the developing current Id, so as to form an electrostatic latent image representing a rectangular patch pattern having a predetermined area, on the photoconductor drum 65.

The estimator 103 calculates a value of a decision coefficient $R^2$, which is the value obtained by dividing variance of an estimated value in a regression model between the toner use amount M and the developing current Id, by variance of a sample value, and estimates deterioration status of the toner, according to the value of the decision coefficient $R^2$. In general, the closer to 1.0 the value of the decision coefficient $R^2$ is, the closer to a linear shape the regression model is.

The estimator 103 changes the DC bias contained in the bias voltage at least to three values, before calculating the value of the decision coefficient $R^2$, to thereby acquire at least three combinations of the measurement result of the toner use amount M and the measurement result of the developing current Id.

The estimator 103 generates a prediction curve C representing a predicted change with time, of the value of the decision coefficient $R^2$, and determines a next toner status estimation timing, on the basis of the prediction curve C.

In the case where the value of the decision coefficient $R^2$ obtained after the generation of the prediction curve C is deviated from the prediction curve C, the estimator 103 updates the prediction curve C.

The estimator 103 compares between the value of the decision coefficient $R^2$ and a first threshold X1. When the value of the decision coefficient $R^2$ is equal to or larger than the first threshold X1, the estimator 103 performs an aging operation, to recover the electric charge amount of the toner.

The estimator 103 compares between the value of the decision coefficient $R^2$ and a second threshold X2 larger than the first threshold X1. When the value of the decision coefficient $R^2$ is equal to or larger than the second threshold X2, the estimator 103 performs an operation to forcibly consume the toner, instead of the aging operation.

Figure 4:
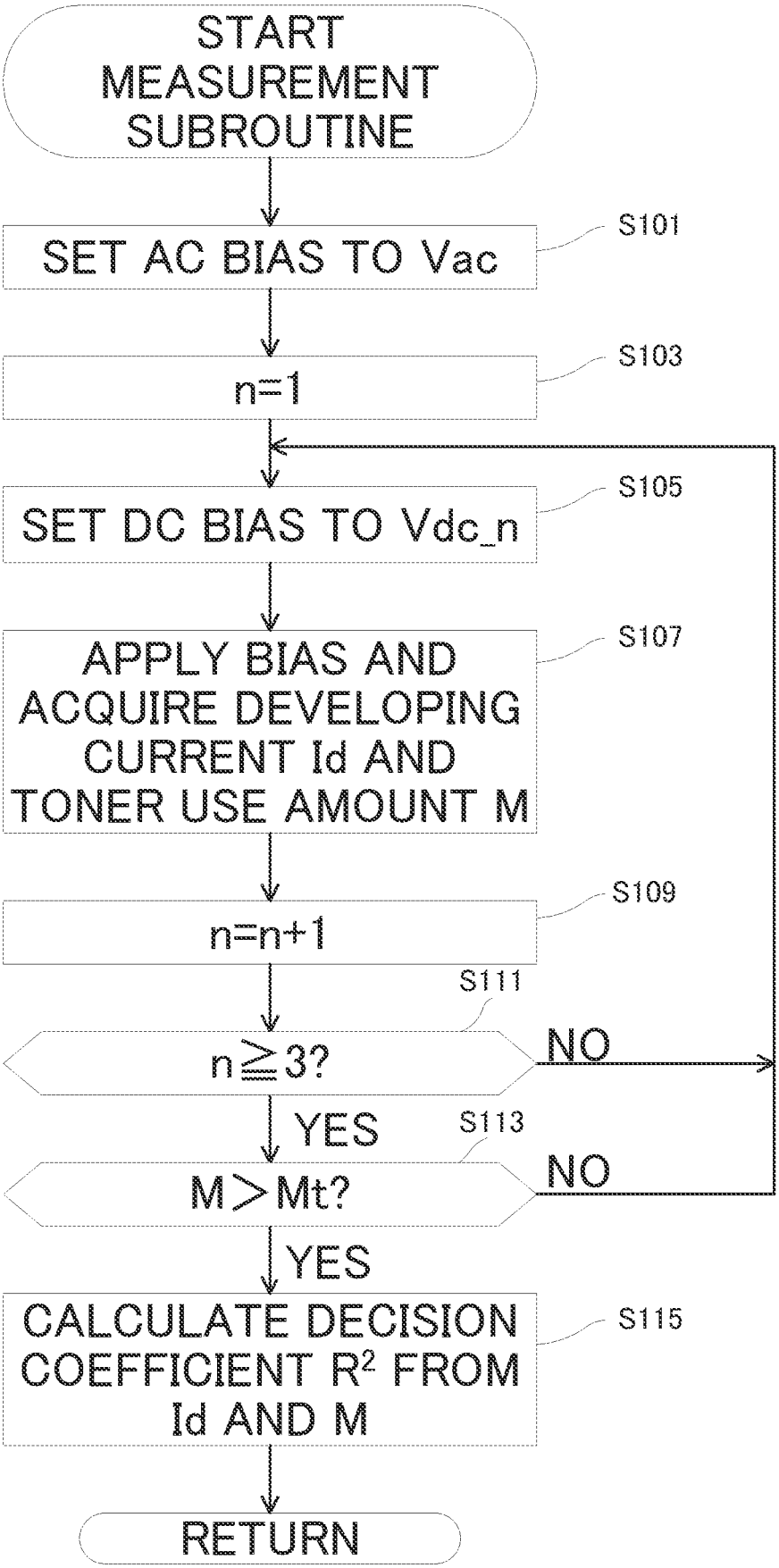
FIG. 4 is a flowchart showing an example of a measurement subroutine.

Referring to FIG. 1 to FIG. 4, an operation performed by the control device 10 will be described hereunder. FIG. 4 is a flowchart showing a measurement subroutine, which is an example of the operation performed by the control device 10.

Step S101: As shown in FIG. 4, the control device 10 sets the AC bias to a predetermined value Vac. Upon completing the operation of step S101, the control device 10 proceeds to step S103.

Step S103: The control device 10 initializes a variable n, for controlling an iterative process, to 1. Upon completing the operation of step S103, the control device 10 proceeds to step S105.

Step S105: The control device 10 sets the DC bias to a specific value Vdc_n. The specific value Vdc_n varies depending on the value of the variable n. Upon completing the operation of step S105, the control device 10 proceeds to step S107.

Step S107: The control device 10 causes the voltage applier 121 to apply the bias to the developing roller 641, and acquires the developing current Id and the toner use amount M corresponding to the bias Vdc_n+Vac. The control device 10 acquires the developing current Id from the current detector 122, and acquires the toner use amount M according to the detection result from the optical sensor 646. Upon completing the operation of step S107, the control device 10 proceeds to step S109.

Step S109: The control device 10 updates the value of the variable n, by adding 1. Upon completing the operation of step S109, the control device 10 proceeds to step S111.

Step S111: The control device 10 decides whether the value of the variable n is equal to or larger than 3. Upon deciding that the value of the variable n is equal to or larger than 3 (Yes at step S111), the control device 10 proceeds to step S113. When the control device 10 decides that the value of the variable n is smaller than 3 (No at step S111), the control device 10 returns to step S105.

Step S113: The control device 10 decides whether the value of the toner use amount M is larger than a predetermined value Mt, in the three combinations of the measurement result of the toner use amount M and the measurement result of the developing current Id. It is preferable that the predetermined value Mt is set to a value of the toner use amount M expected from a normal printing operation of the image forming apparatus 100. Upon deciding that the value of the toner use amount M is larger than the predetermined value Mt (Yes at step S113), the control device 10 proceeds to step S115. When the control device 10 decides that the value of the toner use amount M is equal to or smaller than the predetermined value Mt (No at step S113), the control device 10 returns to step S105.

Step S115: The control device 10 calculates the value of the decision coefficient $R^2$, on the basis of the at least three combinations of the measurement result of the toner use amount M and the measurement result of the developing current Id. The control device 10 had already acquired, before the previous step, the at least three combinations of the measurement result of the toner use amount M and the measurement result of the developing current Id, by changing the DC bias at least to three values. In addition, the at least three combinations include the measurement result of the toner use amount M larger than the predetermined value Mt. Upon completing the operation of step S115, the control device 10 finishes the process of the measurement subroutine.

Figure 5:
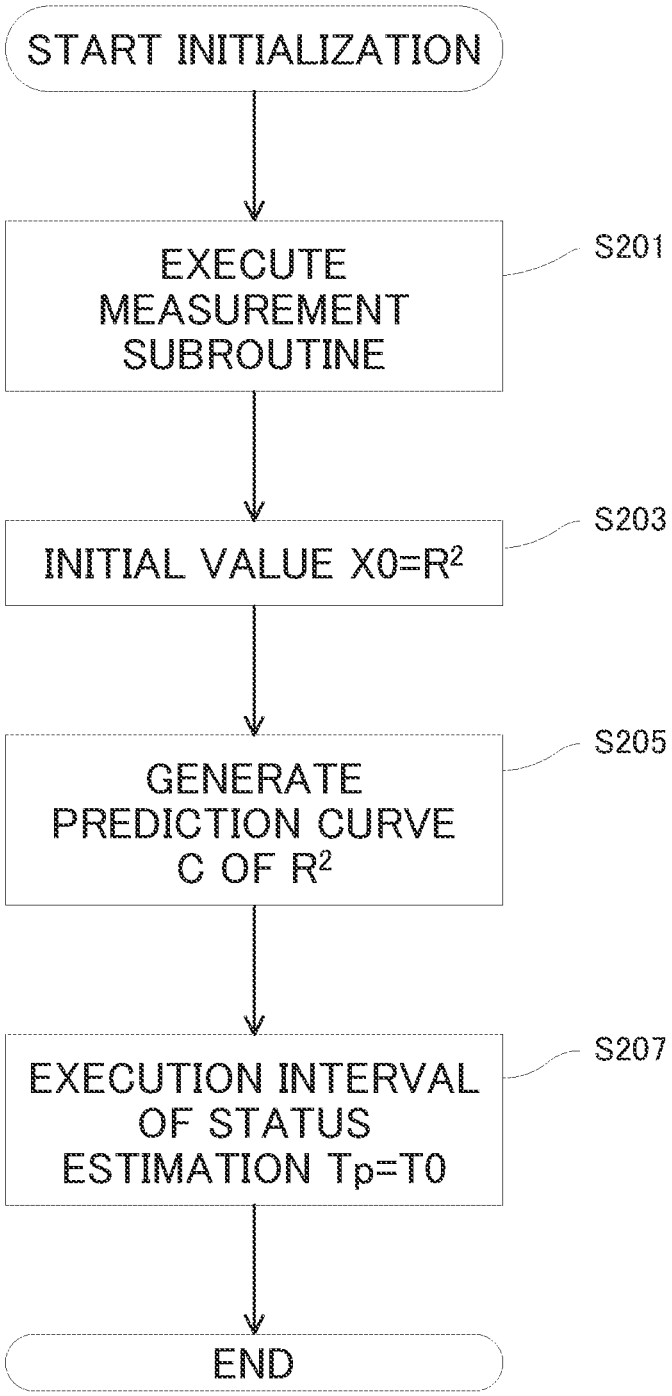
FIG. 5 is a flowchart showing an example of an initialization process.

Referring to FIG. 1 to FIG. 5, further description will be given regarding the operation performed by the control device 10. FIG. 5 is a flowchart showing an initialization process, which is another example of the operation performed by the control device 10. The initialization process is performed only once, for example when the image forming apparatus 100 is shipped from the manufacturing plant.

Step S201: As shown in FIG. 5, the control device 10 executes the measurement subroutine. As result, the control device 10 acquires the value of the decision coefficient $R^2$, based on the measurement result of the toner use amount M and the measurement result of the developing current Id, with respect to an initial toner. Upon completing the operation of step S201, the control device 10 proceeds to step S203.

Step S203: The control device 10 stores the value of the decision coefficient $R^2$ acquired at step S201 in the storage device 11, as an initial value X0. Upon completing the operation of step S203, the control device 10 proceeds to step S205.

Step S205: The control device 10 generates the prediction curve C representing the predicted change with time, of the value of the decision coefficient $R^2$. Upon completing the operation of step S205, the control device 10 proceeds to step S207.

Step S207: The control device 10 sets the value of an execution interval Tp of the status estimation, to an initial value T0. Upon completing the operation of step S203, the control device 10 finishes the initialization process.

Figure 6:
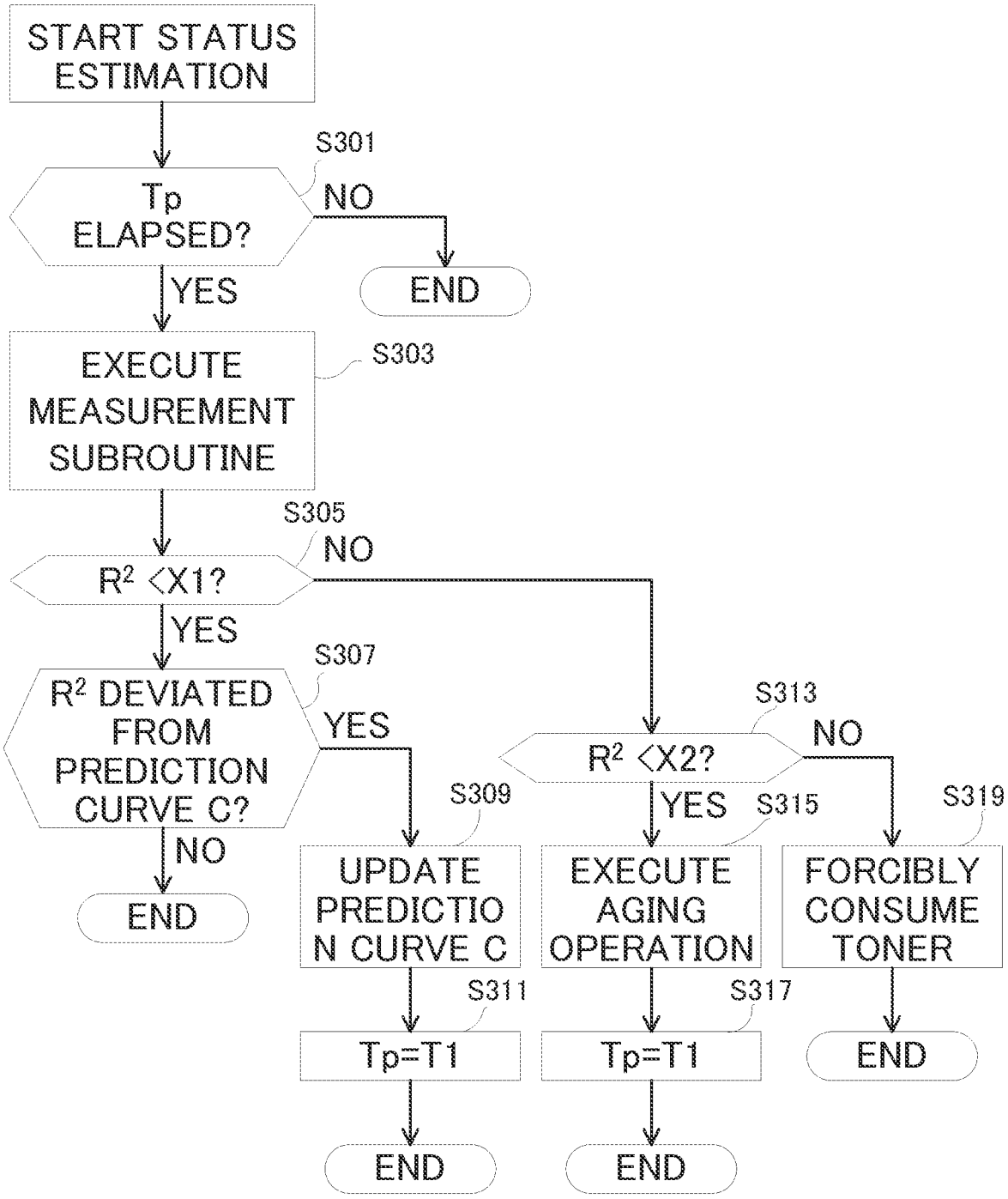
FIG. 6 is a flowchart showing an example of a status estimation process.

Referring to FIG. 1 to FIG. 6, further description will be given regarding the operation performed by the control device 10. FIG. 6 is a flowchart showing a status estimation process, which is another example of the operation performed by the control device 10.

Step S301: As shown in FIG. 6, the control device 10 decides whether the execution interval Tp of the status estimation has elapsed. Upon deciding that the execution interval Tp of the status estimation has elapsed (Yes at step S301), the control device 10 proceeds to step S303. When the control device 10 decides that the execution interval Tp of the status estimation has not elapsed yet (No at step S301), the control device 10 finishes the status estimation process.

Step S303: The control device 10 executes the measurement subroutine. As result, the control device 10 acquires the value of the decision coefficient $R^2$, based on the measurement result of the toner use amount M and the measurement result of the developing current Id, with respect to the toner used for the printing operation. Upon completing the operation of step S303, the control device 10 proceeds to step S305.

Step S305: The control device 10 decides whether the value of the decision coefficient $R^2$ acquired at step S303 is smaller than the first threshold X1. Upon deciding that the value of the decision coefficient $R^2$ is smaller than the first threshold X1 (Yes at step S305), the control device 10 proceeds to step S307. When the control device 10 decides that the value of the decision coefficient $R^2$ is equal to or larger than the first threshold X1 (No at step S305), the control device 10 proceeds to step S313.

Step S307: The control device 10 decides whether the value of the decision coefficient $R^2$ acquired at step S303 is deviated from the prediction curve C. Upon deciding that the value of the decision coefficient $R^2$ acquired at step S303 is deviated from the prediction curve C (Yes at step S307), the control device 10 proceeds to step S309. When the control device 10 decides that the value of the decision coefficient $R^2$ is not deviated from the prediction curve C (No at step S307), the control device 10 finishes the status estimation process.

Step S309: The control device 10 updates the prediction curve C, so as to accord with the value of the decision coefficient $R^2$ acquired at step S303. Upon completing the operation of step S309, the control device 10 proceeds to step S311.

Step S311: The control device 10 changes the value of the execution interval Tp of the status estimation, to a predetermined value T1 (T1<T0). In another words, the control device 10 determines the next toner status estimation timing, according to the prediction curve C. Upon completing the operation of step S311, the control device 10 finishes the status estimation process.

Step S313: The control device 10 decides whether the value of the decision coefficient $R^2$ acquired at step S303 is smaller than the second threshold X2 (>X1). Upon deciding that the value of the decision coefficient $R^2$ is smaller than the second threshold X2 (Yes at step S313), the control device 10 proceeds to step S315. It is when the value of the decision coefficient $R^2$ satisfies an inequality $X1 \leq R^2 < X2$, that the control device 10 proceeds to step S315. When the control device 10 decides that the value of the decision coefficient $R^2$ is equal to or larger than the second threshold X2 (No at step S313), the control device 10 proceeds to step S319.

Step S315: The control device 10 performs the aging operation, by causing the first mixing screw 643 and the second mixing screw 644 to run idle, thereby recovering the electric charge amount of the toner. Upon completing the operation of step S315, the control device 10 proceeds to step S317.

Step S317: The control device 10 changes the value of the execution interval Tp of the status estimation to the predetermined value T1. Thus, the control device 10 determines the next toner status estimation timing, on the basis of the prediction curve C. Upon completing the operation of step S317, the control device 10 finishes the status estimation process.

Step S319: The control device 10 performs the operation to forcibly consume the deteriorated toner. In this operation to forcibly consume the toner, the entirety of the toner that has migrated to the photoconductor drum 65 is disposed of, without being returned to the developing container 640. Upon completing the operation of step S319, the control device 10 finishes the status estimation process.

Through the status estimation process shown in FIG. 6, the aging operation or the forced toner consumption is selected depending on the value of the decision coefficient $R^2$, and the execution interval Tp of the status estimation is adjusted to an appropriate value. Therefore, a downtime arising from unnecessary toner consumption and status estimation can be reduced.

Figure 7:
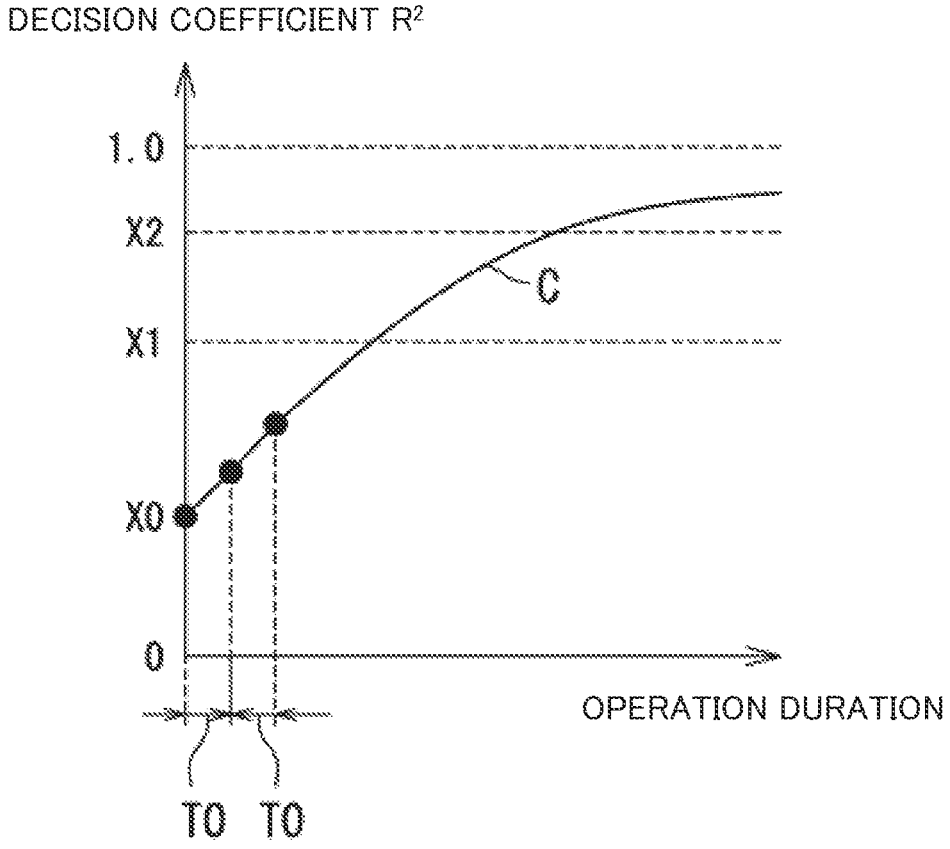
FIG. 7 is a graph showing an example of a prediction curve of a value of decision coefficient.

Referring to FIG. 1 to FIG. 7, the prediction curve C will be described hereunder. FIG. 7 is a graph showing an example of the prediction curve C of the value of the decision coefficient $R^2$. In FIG. 7, the horizontal axis represents the operation duration of the image forming apparatus 100, and the vertical axis represents the value of the decision coefficient $R^2$.

As shown in FIG. 7, the value of the decision coefficient $R^2$ at the operation duration "0" is the initial value X0. As long as the value of the decision coefficient $R^2$ is not deviated from the prediction curve C, the control device 10 executes the status estimation process shown in FIG. 6, each time the initial value T0 of the execution interval Tp of the status estimation elapses. Thereafter, when the toner is deteriorated to such an extent that the value of the decision coefficient $R^2$ satisfies the inequality $X1 \leq R^2 < X2$, the aging operation is performed. When the toner is further deteriorated to such an extent that the value of the decision coefficient $R^2$ satisfies an inequality $R^2 \geq X2$, the toner is forcibly consumed.

Working Example 1

Hereunder, a working example of the disclosure will be described. The driving condition, the bias condition, the toner condition and the deterioration condition for the working example are specified below. However, the disclosure is not limited to the following working example.

[Driving Condition]

Printing speed: 60 sheets/min.

Drum circumferential velocity: 280 mm/sec.

Developing agent carrier linear velocity: 504 mm/sec.

[Bias Condition]

Developing DC bias: 50 V to 110 V

Developing AC bias: 1200 Vpp

Developing AC frequency: 8000 Hz

Developing AC duty ratio: 50%

Drum surface potential after exposure: 20 V

[Toner Condition]

Toner particle diameter: 6.8 μm

Toner polarity: Positive

[Deterioration Condition]

Initial toner: No printing

Deteriorated toner A: 10% printing 20 min. (corresponding to 1200 sheets)

Deteriorated toner B: 0% printing 30 min. (corresponding to 1800 sheets)

The "initial toner" corresponds to the toner in the image forming apparatus 100 that has been shipped from the manufacturing plant. The "deteriorated toner A" corresponds to the toner deteriorated by high-density printing, and the "deteriorated toner B" corresponds to the toner deteriorated by low-density printing.

Figure 8:
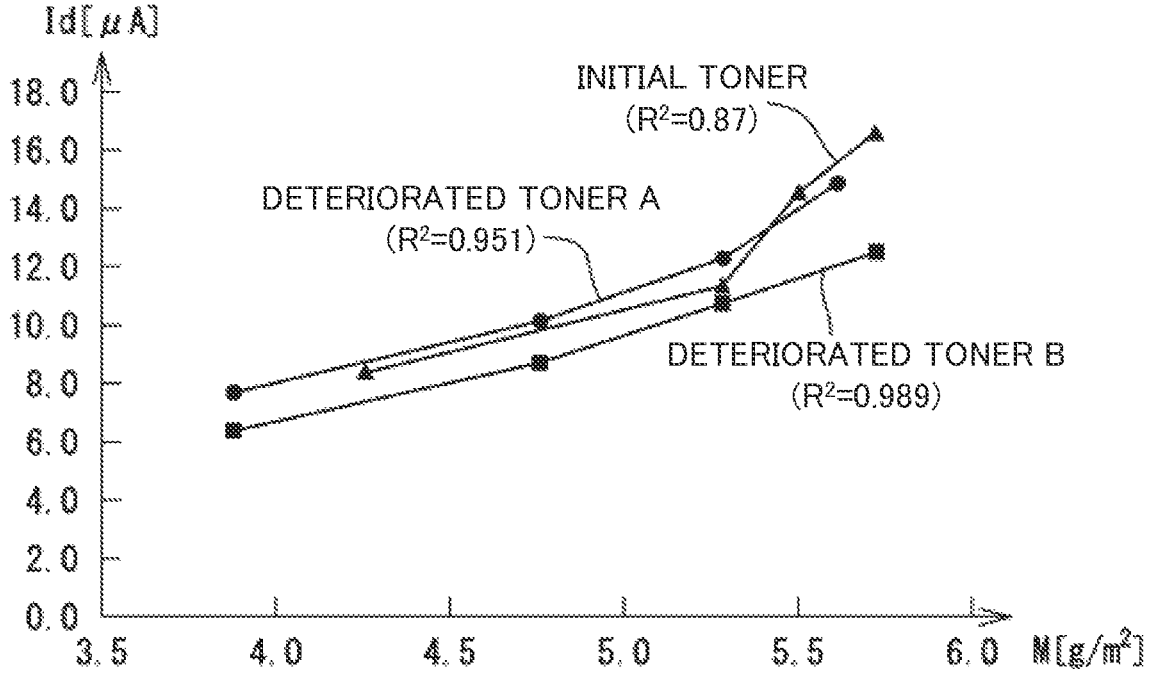
FIG. 8 is a graph showing an example of a correlation between a toner use amount and developing current.

Referring to FIG. 8, a correlation between the toner use amount M and the developing current Id in this working example will be described. FIG. 8 is a graph showing an example of the correlation between the toner use amount M and the developing current Id. In FIG. 8, the horizontal axis represents the toner use amount M [$g/m^2$], and the vertical axis represents the developing current Id [μA].

As shown in FIG. 8, the graph representing the initial toner includes a first section ($4.2 \leq M < 5.3$) showing a gentle inclination, and a second section ($5.3 \leq M < 5.7$) showing a sharp inclination. In the case of the initial toner, the value of the decision coefficient $R^2$ was 0.87. Presumably, the second section showing the sharp inclination reflects a steep peak on a relatively higher side, in the distribution of the electric charge amount of the initial toner.

The graph representing the deteriorated toner A is closer to a straight line, than the graph of the initial toner. In the case of the deteriorated toner A, the value of the decision coefficient $R^2$ was 0.951.

The graph representing the deteriorated toner B is closer to a straight line, than the graph of the deteriorated toner A. In the case of the deteriorated toner B, the value of the decision coefficient $R^2$ was 0.989. Presumably, the increase in the value of the decision coefficient $R^2$ in comparison with the initial toner reflects a situation that, with the progress of the deterioration of the toner, the peak in the distribution of the electric charge amount is shifted to a lower side, and also becomes less steep.

As described thus far, the image forming apparatus 100 according to the foregoing embodiment is capable of estimating the deterioration status of the toner, contained in the developing agent.

In the case where new toner is supplied from the toner supply device 5, when the deteriorated toner is present in the developing container 640, the image is prone to become fogged. The aforementioned existing image forming apparatus is unable to prevent the occurrence of the image fogging arising from fluctuation in distribution of the electric charge amount, caused by the deterioration of the toner. With the configuration according to the foregoing embodiment, in contrast, the deterioration status of the toner can be estimated, and therefore the aging operation or forced consumption of the toner is performed at an appropriate timing. Consequently, the occurrence of the image fogging can be prevented.

The embodiment of the disclosure has been described as above, with reference to the drawings. However, the disclosure is not limited to the foregoing embodiment, but may be implemented in various manners without departing from the scope of the disclosure. The plurality of constituent elements disclosed in the foregoing embodiment may be combined as desired, to achieve various inventions. For example, some constituent elements may be excluded, from those disclosed in the foregoing embodiment. The drawings each schematically illustrate the essential constituent elements for the sake of clarity, and the thickness, the length, and the number of pieces of each of the illustrated constituent elements may differ from the actual ones, depending on the convenience in making up the drawings. Further, the material, the shape, and the dimensions of the constituent elements described in the foregoing embodiment are merely exemplary, and may be modified in various manners without substantially departing from the effects expected from the present invention.

Although the image forming apparatus 100 is exemplified by the color printer in the foregoing embodiment, the disclosure is not limited thereto. The image forming apparatus 100 may be any apparatus that forms an image using the electrophotography technique.

Although the two-component developing agent is employed as the developing agent in the foregoing embodiment, the disclosure is not limited thereto. The developing agent may be a one-component developing agent.

In the foregoing embodiment, further, the optical sensor 646 is provided close to the photoconductor drum 65, to directly measure the weight of the toner stuck to the photoconductor drum 65. Instead, the control device 10 may indirectly measure the toner use amount M, represented by the weight per unit area of the toner that has migrated from the developing roller 641 to the photoconductor drum 65, using a density sensor that detects the density of the toner transferred to the intermediate transfer belt 72 or the sheet P.

INDUSTRIAL APPLICABILITY

The disclosure is applicable to the technical field of the image forming apparatus.

While the present disclosure has been described in detail with reference to the embodiments thereof, it would be apparent to those skilled in the art the various changes and modifications may be made therein within the scope defined by the appended claims.

What is claimed is:

1. An image forming apparatus comprising:

an image carrier that carries an electrostatic latent image;

a developing device including a developing agent carrier that carries a developing agent at least containing toner;

a voltage applier that applies a bias voltage to the developing agent carrier, to cause the toner to migrate from the developing agent carrier to the image carrier;

a current detector that measures developing current flowing between the developing agent carrier and the image carrier;

a weight detector that measures weight of the toner stuck to the image carrier; and a control device including a processor, and configured to act, when the processor executes a control program, as:

a first measurer that acquires a toner use amount indicating weight per unit area of the toner that has migrated from the developing agent carrier to the image carrier, according to a detection result provided by the weight detector;

a second measurer that acquires the developing current from the current detector; and an estimator that calculates a value of decision coefficient, obtained by dividing variance of an estimated value in a regression model between the toner use amount and the developing current, by variance of a sample value, and estimates deterioration status of the toner, according to the value of the decision coefficient.

2. The image forming apparatus according to claim 1, wherein the estimator changes a DC bias in the bias voltage at least to three values, before calculating the value of the decision coefficient, and acquires at least three combinations of a measurement result of the toner use amount and a measurement result of the developing current.

3. The image forming apparatus according to claim 1, wherein the estimator generates a prediction curve indicating a predicted change with time of the value of the decision coefficient, and determines a next status estimation timing of the toner deterioration status, on a basis of the prediction curve.

4. The image forming apparatus according to claim 3, wherein the estimator updates the prediction curve, when the value of the decision coefficient, obtained after generating the prediction curve, is deviated from the prediction curve.

5. The image forming apparatus according to claim 1, wherein the estimator compares between the value of the decision coefficient and a first threshold, and performs, when the value of the decision coefficient is equal to or larger than the first threshold, an aging operation for recovering an electric charge amount of the toner.

6. The image forming apparatus according to claim 5, wherein the estimator compares between the value of the decision coefficient and a second threshold larger than the first threshold, and performs, when the value of the decision coefficient is equal to or larger than the second threshold, an operation to forcibly consume the toner, instead of the aging operation.

7. The image forming apparatus according to claim 2, wherein the estimator calculates the value of the decision coefficient, when a value of the toner use amount is larger than a predetermined value, in the at least three combinations, and keeps from calculating the value of the decision coefficient, when the value of the toner use amount is equal to or smaller than the predetermined value.

* * * * *